US011335517B1

(12) United States Patent
Chu et al.

(10) Patent No.: US 11,335,517 B1
(45) Date of Patent: May 17, 2022

(54) KEY STRUCTURE

(71) Applicant: Primax Electronics Ltd., Taipei (TW)

(72) Inventors: Chun-Lin Chu, Taipei (TW); Shu-An Huang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/332,561

(22) Filed: May 27, 2021

(30) Foreign Application Priority Data

Apr. 1, 2021 (TW) ..... 110112097

(51) Int. Cl.
*H01H 3/12* (2006.01)
*H01H 13/705* (2006.01)

(52) U.S. Cl.
CPC ..... *H01H 3/122* (2013.01); *H01H 13/705* (2013.01); *H01H 2221/058* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS 8,957,332 B2 * 2/2015 Yamada ..... H01H 3/125 200/344
2014/0367240 A1 * 12/2014 Lin ..... H01H 3/125 200/344
2018/0025859 A1 * 1/2018 Chen ..... H01H 13/7065 200/5 A

* cited by examiner

*Primary Examiner* — Ahmed M Saeed
(74) *Attorney, Agent, or Firm* — Kirton McConkie; Evan R. Witt

(57) ABSTRACT

A key structure includes a frame member, a keycap and a stabilizer bar. The keycap includes first and second clamping members. The first clamping member includes a first upper stopping part, a first lower stopping part and a first lateral stopping part. The second clamping member includes a second upper stopping part, a second lower stopping part and a second lateral stopping part. The stabilizer bar includes a shaft part, a first leg part and a second leg part. The shaft part is received within a hook of the frame member. The first leg part is received within the first clamping member. The second leg part is received within the second clamping member. The first lateral stopping part is pushed against the first leg part along a first direction. The second lateral stopping part is pushed against the second leg part along a second direction.

18 Claims, 11 Drawing Sheets

KEY STRUCTURE

FIELD OF THE INVENTION

The present invention relates to a key structure, and more particularly to a multiple key structure having a noise reduction function.

BACKGROUND OF THE INVENTION

Generally, a keyboard device comprises plural keys. In addition to the ordinary keys, the plural keys comprise some keys with special appearance (e.g., multiple keys). Since the length of the multiple key is much larger than its width, some drawbacks occur. For example, while the multiple key is pressed down by the user, the multiple key is readily tilted and even jammed.

For solving this problem, a stabilizer bar is usually installed in the internal portion of the key structure. When the keycap is pressed down, the two lateral sides of the keycap can be maintained in the equilibrium state through the stabilizer bar.

In order to avoid the problem of the assembly interference caused by the manufacturing tolerance, it is a common method to reserve a gap at the junction between the stabilizer bar and the keycap. However, due to the gap, another problem occurs. For example, while the keycap is pressed down, the collision or movement between the keycap and the stabilizer bar is readily generated. Due to the collision or movement, unpleasant noise is generated and the operation of the user is adversely affected.

In other words, the conventional key structure needs to be further improved.

SUMMARY OF THE INVENTION

For solving the drawbacks of the conventional technologies, the present invention provides a key structure. The key structure is specially designed. Consequently, the gap that readily results in the collision or movement between the keycap and the stabilizer bar is eliminated, and the noise reduction efficacy is enhanced. In addition, the problem of the assembly interference caused by the manufacturing tolerance can be avoided or reduced.

In accordance with an aspect of the present invention, a key structure is provided. The key structure includes a frame member, a keycap and a stabilizer bar. The frame member includes at least one hook. The keycap including a bottom surface, a first clamping member and a second clamping member. The bottom surface faces the frame member. The first clamping member includes a first upper stopping part, a first lower stopping part and a first lateral stopping part. The second clamping member includes a second upper stopping part, a second lower stopping part and a second lateral stopping part. The stabilizer bar is arranged between the keycap and the frame member, and includes a shaft part, a first leg part and a second leg part. The first leg part and the second leg part are formed by bending two ends of the shaft part, respectively. The shaft part is received within the at least one hook. The first leg part is received within the first clamping member. The second leg part is received within the second clamping member. The first lateral stopping part is pushed against the first leg part along a first direction. The second lateral stopping part is pushed against the second leg part along a second direction. The first direction and the second direction are opposed to each other.

In an embodiment, the keycap further includes a first retaining wall, and the first retaining wall is protruded from the bottom surface of the keycap and toward the frame member.

In an embodiment, the first lower stopping part and the first lateral stopping part are disposed on the first retaining wall.

In an embodiment, the first retaining wall has a first opening.

In an embodiment, the first upper stopping part is protruded from the bottom surface of the keycap and toward the frame member, and the first upper stopping part is inserted into the first opening.

In an embodiment, the first opening is a closed-type opening or an open-type opening.

In an embodiment, the keycap further includes a first pillar structure, and the first pillar structure is protruded from the bottom surface of the keycap and toward the frame member. The frame member further includes a first sleeve, and the first sleeve has a first hollow portion.

In an embodiment, the key structure further includes an elastic element and a circuit board, and the first pillar structure is inserted into the first hollow portion and contacted with the elastic element. When the elastic element is subjected to deformation, the circuit board is triggered by the elastic element.

In an embodiment, the first leg part and the second leg part are arranged between the first lateral stopping part and the second lateral stopping part.

In an embodiment, the first lateral stopping part and the second lateral stopping part are arranged between the first leg part and the second leg part.

In accordance with another aspect of the present invention, a key structure is provided. The key structure includes a frame member, a keycap and a stabilizer bar. The frame member includes at least one hook. The keycap including a bottom surface, a first retaining wall and a second retaining wall. The bottom surface faces the frame member. The first retaining wall and the second retaining wall are protruded from the bottom surface of the keycap and toward the frame member. The first retaining wall has a first opening. The stabilizer bar is arranged between the keycap and the frame member, and includes a shaft part, a first leg part and a second leg part. The first leg part and the second leg part are formed by bending two ends of the shaft part, respectively. The shaft part is received within the at least one hook. The shaft part is only permitted to be rotated along an axial direction through the at least one hook. The first retaining wall is pushed against the first leg part along a first direction. The second retaining wall is pushed against the second leg part along a second direction. The first direction and the second direction are opposed to each other. In addition, the first retaining wall and the second retaining wall can stop the shaft part from being arbitrarily moved along the axial direction.

In an embodiment, the keycap further includes a first upper stopping part, a first lower stopping part and a first lateral stopping part. The first leg part is received within a region between the first upper stopping part, the first lower stopping part and the first lateral stopping part. The first lateral stopping part is pushed against the first leg part along the first direction.

In an embodiment, the first upper stopping part is protruded from the bottom surface of the keycap and toward the frame member, and the first upper stopping part is inserted into the first opening. The first lower stopping part and the first lateral stopping part are disposed on the first retaining wall.

In an embodiment, the first opening is a closed-type opening or an open-type opening.

In an embodiment, the keycap further includes a first pillar structure, and the first pillar structure is protruded from the bottom surface of the keycap and toward the frame member. The frame member further includes a first sleeve, and the first sleeve has a first hollow portion.

In an embodiment, the key structure further includes an elastic element and a circuit board. The first pillar structure is inserted into the first hollow portion and contacted with the elastic element. When the elastic element is subjected to deformation, the circuit board is triggered by the elastic element.

In an embodiment, the first leg part and the second leg part are arranged between the first retaining wall and the second retaining wall.

In an embodiment, the first retaining wall and the second retaining wall are arranged between the first leg part and the second leg part.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

Figure 1:
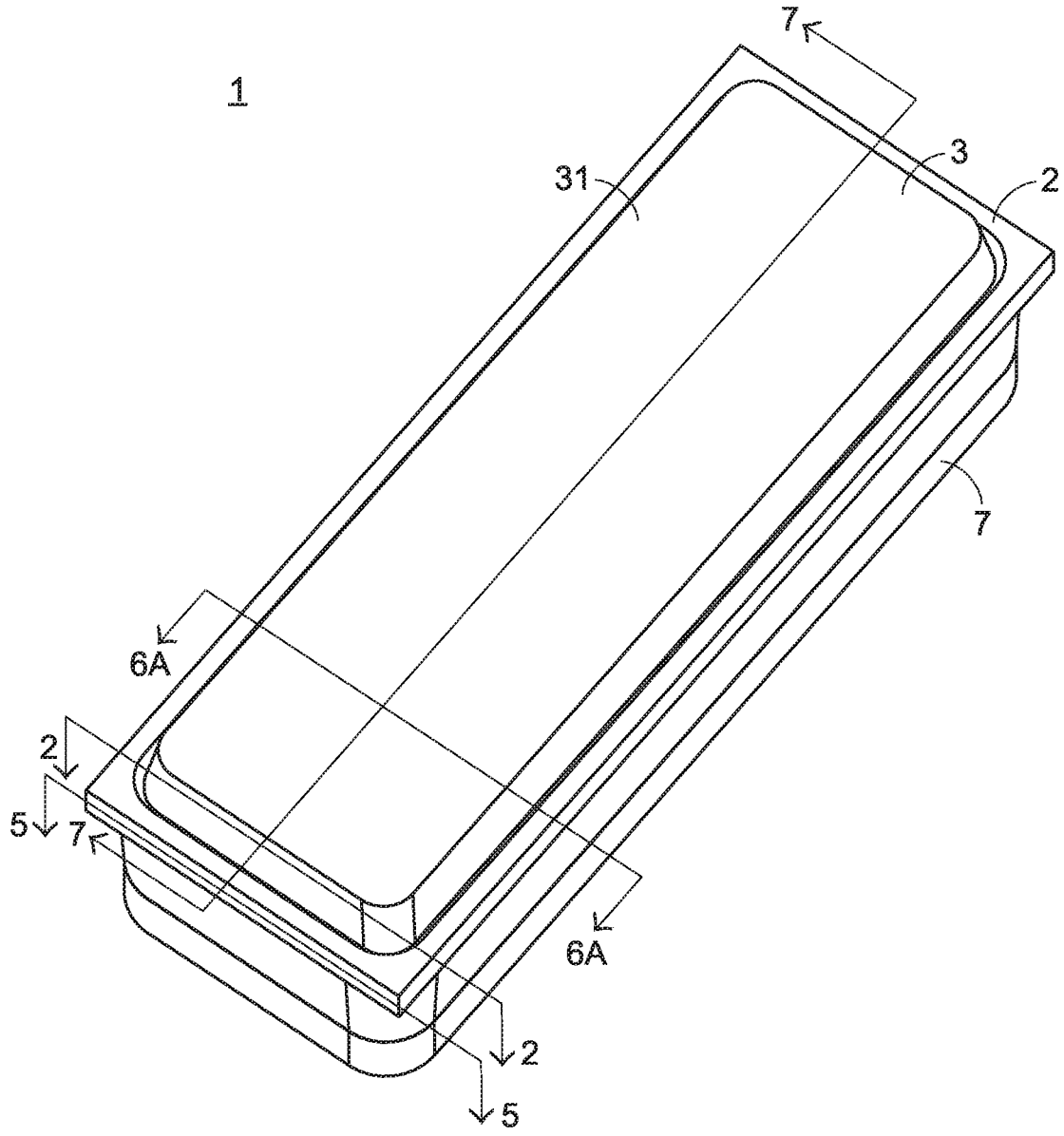
FIG. 1 is a schematic perspective view illustrating a key structure according to an embodiment of the present invention.
Figure 2:
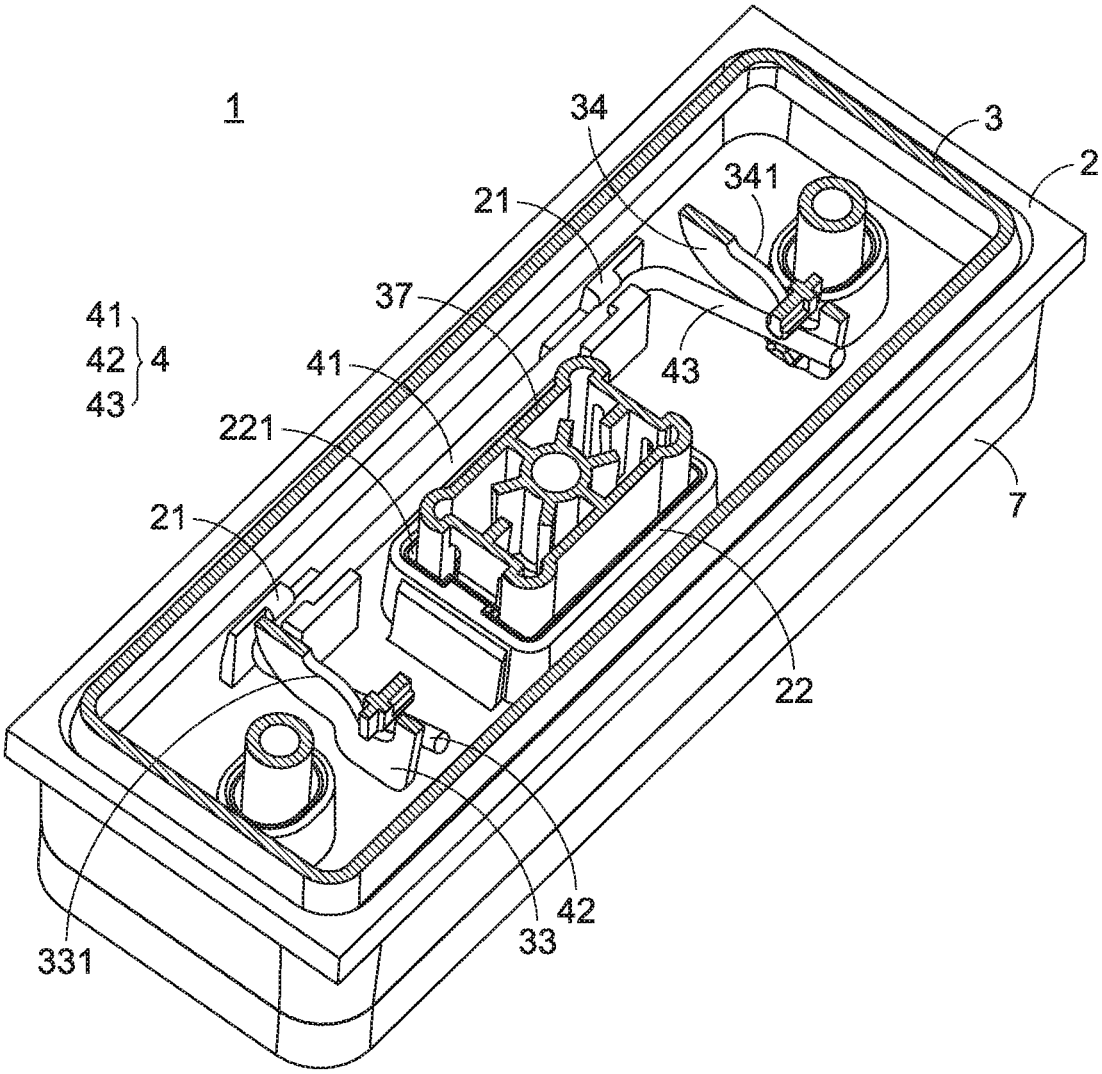
FIG. 2 is a schematic cutaway and perspective view illustrating the key structure as shown in FIG. 1 and taken along the line 2-2.
Figure 3:
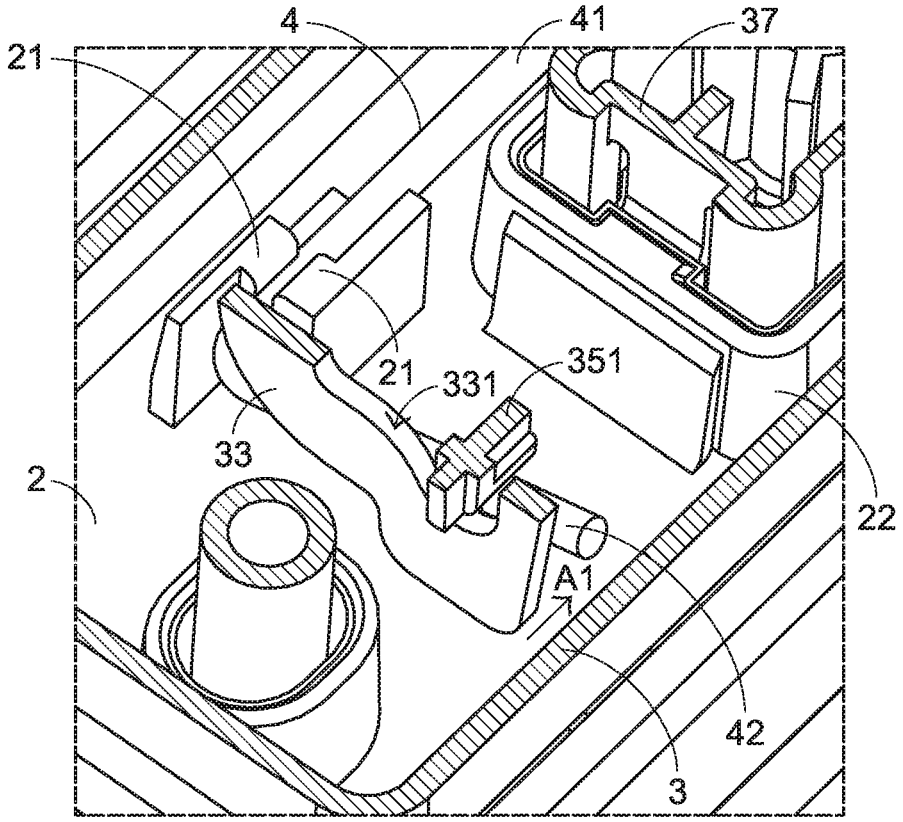
FIG. 3 is a schematic enlarged view illustrating a portion of the key structure as shown in FIG. 2.
Figure 4A:
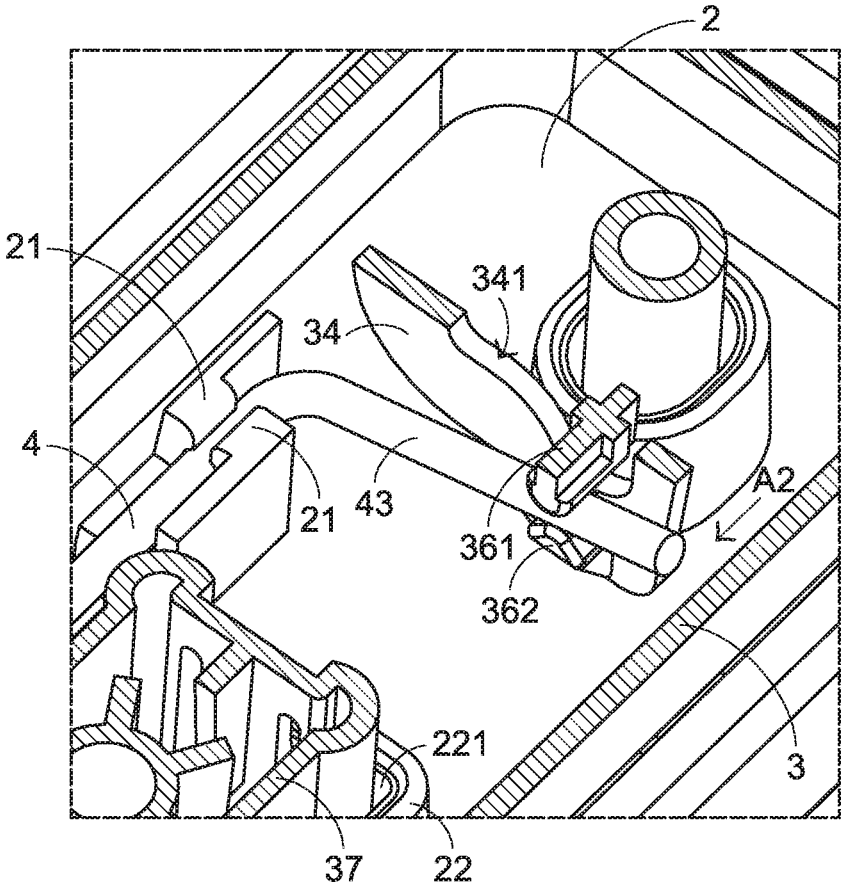
FIG. 4A is a schematic enlarged view illustrating another portion of the key structure as shown in FIG. 2.
Figure 4B:
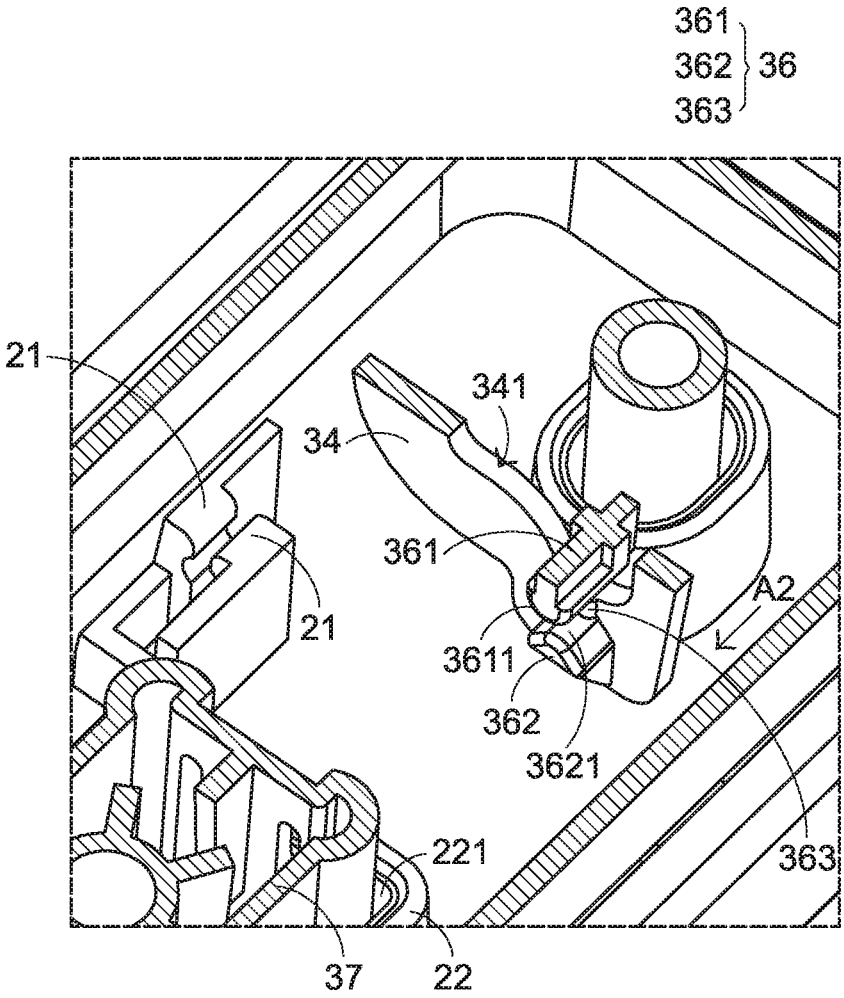
FIG. 4B is a schematic view of the key structure as shown in FIG. 4A, in which the stabilizer bar is not shown.
Figure 5:
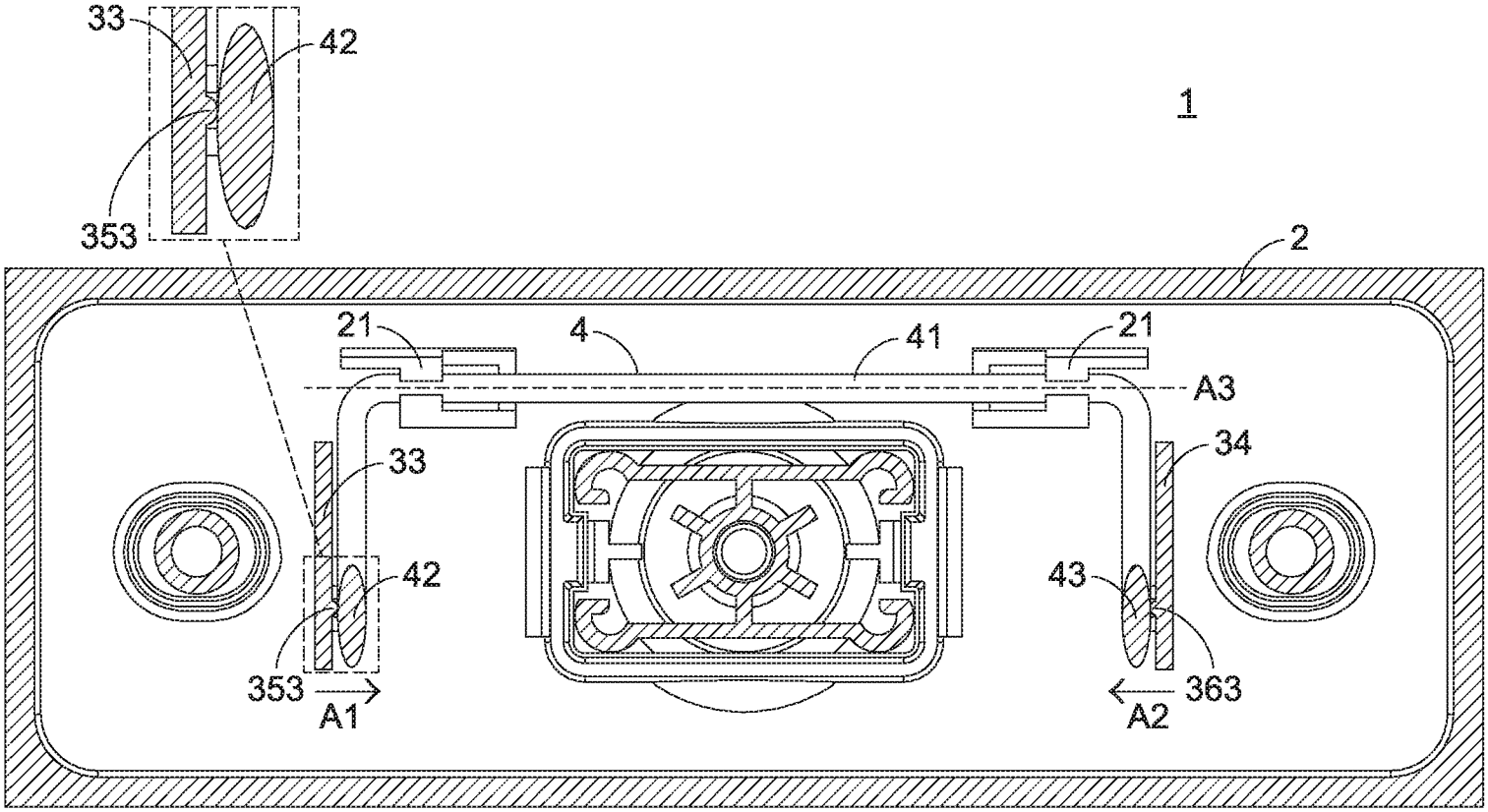
FIG. 5 is a schematic cutaway and top view illustrating the key structure as shown in FIG. 1 and taken along the line 5-5.
Figure 6A:
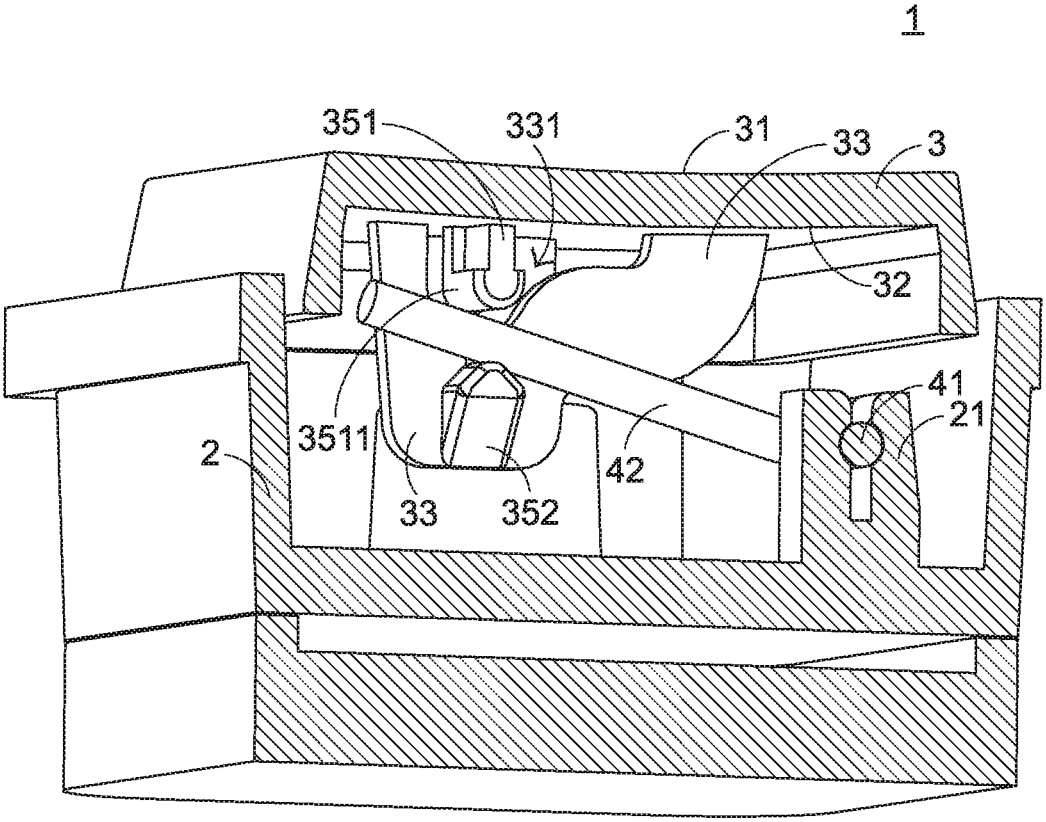
FIG. 6A is a schematic cutaway and perspective view illustrating the key structure as shown in FIG. 1 and taken along the line 6A-6A.
Figure 6B:
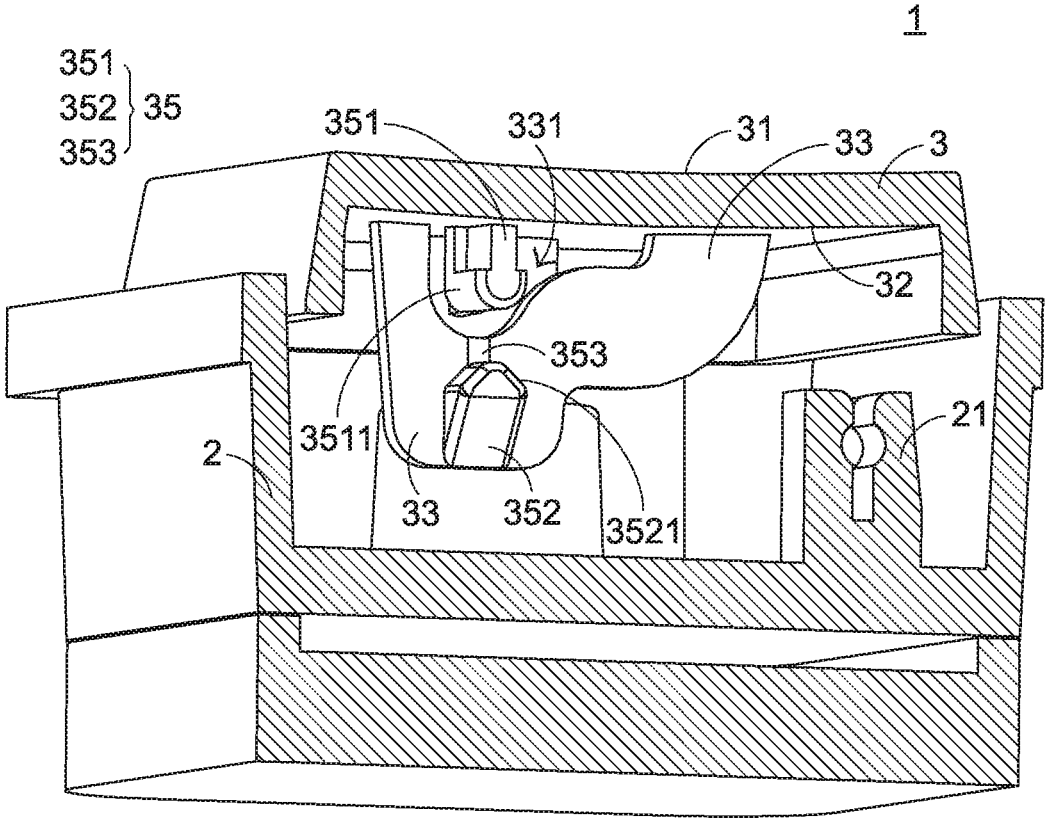
FIG. 6B is a schematic view of the key structure as shown in FIG. 6A, in which the stabilizer bar is not shown.
Figure 7:
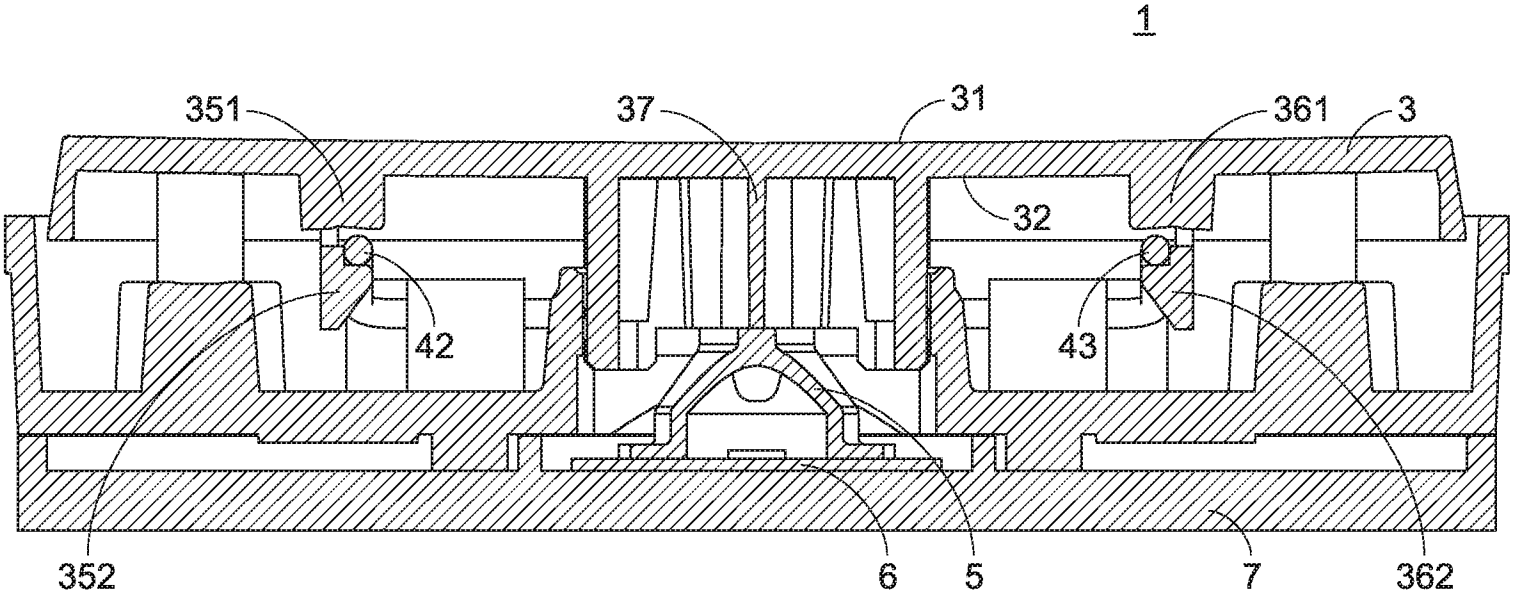
FIG. 7 is a schematic cutaway and side view illustrating the key structure as shown in FIG. 1 and taken along the line 7-7.
Figure 8:
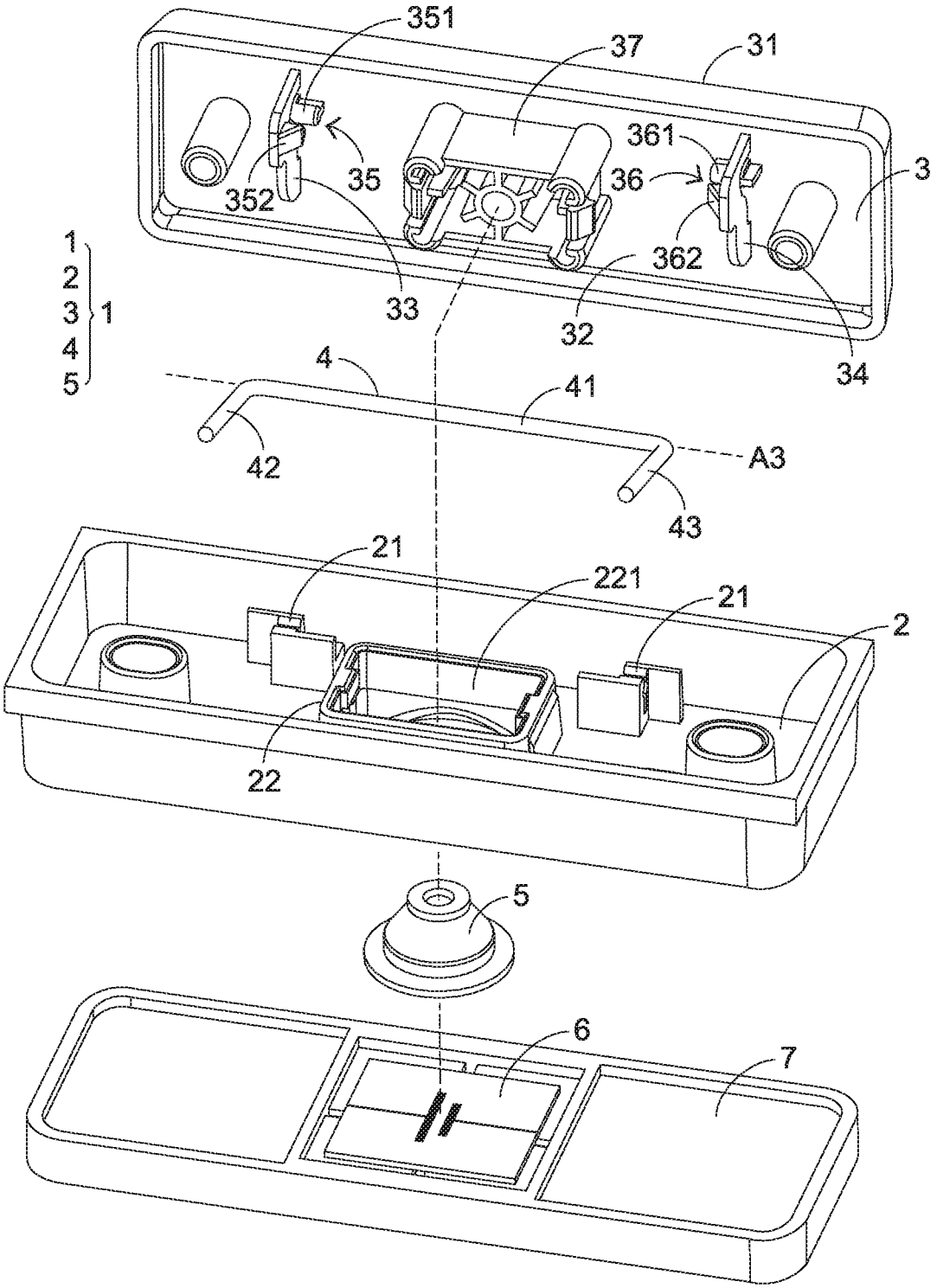
FIG. 8 is a schematic exploded view illustrating the key structure according to the embodiment of the present invention.

FIG. 1 is a schematic perspective view illustrating a key structure according to an embodiment of the present invention. FIG. 2 is a schematic cutaway and perspective view illustrating the key structure as shown in FIG. 1 and taken along the line 2-2. FIG. 3 is a schematic enlarged view illustrating a portion of the key structure as shown in FIG. 2. FIG. 4A is a schematic enlarged view illustrating another portion of the key structure as shown in FIG. 2. FIG. 4B is a schematic view of the key structure as shown in FIG. 4A, in which the stabilizer bar is not shown. FIG. 5 is a schematic cutaway and top view illustrating the key structure as shown in FIG. 1 and taken along the line 5-5. FIG. 6A is a schematic cutaway and perspective view illustrating the key structure as shown in FIG. 1 and taken along the line 6A-6A. FIG. 6B is a schematic view of the key structure as shown in FIG. 6A, in which the stabilizer bar is not shown. FIG. 7 is a schematic cutaway and side view illustrating the key structure as shown in FIG. 1 and taken along the line 7-7. FIG. 8 is a schematic exploded view illustrating the key structure according to the embodiment of the present invention.

Please refer to FIGS. 1 to 8. In an embodiment, the key structure 1 comprises a frame member 2, a keycap 3, a stabilizer bar 4, an elastic element 5 and a circuit board 6. The frame member 2 comprises at least one hook 21. The keycap 3 comprises a press surface 31 and a bottom surface 32, which are opposed to each other. The press surface 31 can be touched by the user's finger. The bottom surface 32 is an inner surface of the keycap 3. In addition, the bottom surface 32 faces the frame member 2.

The keycap 3 further comprises two retaining walls 33 and 34. The two retaining walls 33 and 34 are protruded from the bottom surface 32 of the keycap 3 and toward the frame member 2. The retaining wall 33 has an opening 331. The retaining wall 34 has an opening 341.

Please refer to FIGS. 2, 3, 4A, 4B, 5, 6A and 6B again. The keycap 3 further comprises two clamping members 35 and 36. The clamping member 35 comprises an upper stopping part 351, a lower stopping part 352 and a lateral stopping part 353. The clamping member 36 comprises an upper stopping part 361, a lower stopping part 362 and a lateral stopping part 363.

The upper stopping part 351 of the clamping member 35 is protruded from the bottom surface 32 of the keycap 3 and toward the frame member 2. In addition, the upper stopping part 351 is inserted into the opening 331 of the retaining wall 33. The lower stopping part 352 and the lateral stopping part 353 are disposed on the retaining wall 33. Since the retaining wall 33 is equipped with the opening 331 near the bottom surface 32 of the keycap 3, the lower stopping part 352 and the lateral stopping part 353 disposed on the retaining wall 33 have resettable elasticity. As shown in the drawings, the upper stopping part 351 is linked with the lower stopping part 352 and the lateral stopping part 353 through the retaining wall 33. In other words, the upper stopping part 351 is not directly contacted with the lower stopping part 352 or the lateral stopping part 353. Consequently, a specified gap between the upper stopping part 351 and the lower stopping part 352 or between the upper stopping part 351 and the lateral stopping part 353 is maintained. This structural design is helpful for maintaining the resettable elasticity of the lower stopping part 352 and the lateral stopping part 353.

The upper stopping part 361 of the clamping member 36 is protruded from the bottom surface 32 of the keycap 3 and toward the frame member 2. In addition, the upper stopping part 361 is inserted into the opening 341 of the retaining wall 34. The lower stopping part 362 and the lateral stopping part 363 are disposed on the retaining wall 34. Since the retaining wall 34 is equipped with the opening 341 near the bottom surface 32 of the keycap 3, the lower stopping part 362 and the lateral stopping part 363 disposed on the retaining wall 34 have resettable elasticity. As shown in the drawings, the upper stopping part 361 is linked with the lower stopping part 362 and the lateral stopping part 363 through the retaining wall 34. In other words, the upper stopping part 361 is not directly contacted with the lower stopping part 362 or the lateral stopping part 363. Consequently, a specified gap between the upper stopping part 361 and the lower stopping part 362 or between the upper stopping part 361 and the lateral stopping part 363 is maintained. This structural design is helpful for maintaining the resettable elasticity of the lower stopping part 362 and the lateral stopping part 363.

Please refer to FIGS. 3, 4A, 4B, 6A and 6B again. As mentioned above, the openings 331 and 341 are respectively formed in the retaining walls 33 and 34 and contacted with the bottom surface 32 of the keycap 3. In an embodiment, the openings 331 and 341 are closed-type openings. It is noted that numerous modifications and alterations may be made while retaining the teachings of the invention. For example, in another embodiment, the openings 331 and 341 are open-type openings and thus the retaining walls 33 and 34 have the structures similar to elastic arms. Due to this structural design, the retaining walls 33 and 34 also have resettable elasticity.

Please refer to FIGS. 2, 3, 4A, 4B and 5 again. The stabilizer bar 4 is arranged between the keycap 3 and the frame member 2. The stabilizer bar 4 is made of metallic material. The frame member 2 comprises a shaft part 41 and two leg parts 42 and 43. The two leg parts 42 and 43 are formed by bending two ends of the shaft part 41, respectively. When the stabilizer bar 4 is assembled with the frame member 2 and the keycap 3, the shaft part 41 is received within the at least one hook 21, and the leg parts 42 and 43 are respectively received within the clamping members 35 and 36. Under this circumstance, the lateral stopping part 353 is pushed against the leg part 42 along a direction A1, and the lateral stopping part 363 is pushed against the leg part 43 along a direction A2. The direction A1 and the direction A2 are opposed to each other. Since the shaft part 41 is received within the hook 21 and limited by the hook 21, the shaft part 41 is permitted to be rotated along an axial direction A3 only. When the lateral stopping part 353 on the retaining wall 33 is pushed against the leg part 42 along the direction A1 and the lateral stopping part 363 on the retaining wall 34 is pushed against the leg part 43 along the direction A2, the retaining walls 33 and 34 can naturally stop the shaft part 41 from being arbitrarily moved along the axial direction A3.

Due to the above structural design, the gap that readily results in the collision or movement between the keycap 3 and the stabilizer bar 4 is eliminated. Consequently, the noise reduction efficacy is enhanced, and the tactile feel of pressing the key structure 1 is improved. Moreover, since the lateral stopping part 353 on the retaining wall 33 and the lateral stopping part 363 on the retaining wall 34 have resettable elasticity, the problem of the assembly interference caused by the manufacturing tolerance of the keycap 3 and the stabilizer bar 4 can be avoided or reduced.

Please refer to FIGS. 4B, 5 and 6B again. As shown in the top view of FIG. 5, the lateral stopping part 353 on the retaining wall 33 and the lateral stopping part 363 on the retaining wall 34 have arc-shaped and raised cross sections. As shown in the perspective views of FIGS. 4B and 6B, the lateral stopping part 353 on the retaining wall 33 and the lateral stopping part 363 on the retaining wall 34 have semi-cylindrical profiles. In other words, the lateral stopping parts 353 and 363 of this embodiment are pushed against the leg parts 42 and 43 in a line contact manner rather than a surface contact manner. Consequently, the abrasions between the lateral stopping parts 353, 363 and the leg parts 42, 43 can be alleviated.

Please refer to FIGS. 2, 3, 4A, 4B, 6A, 6B and 7 again. When the leg parts 42 and 43 of the stabilizer bar 4 are respectively received within the clamping members 35 and 36, the leg parts 42 and 43 of the stabilizer bar 4 are possibly not continuously contacted with the upper stopping parts 351 and 361 or the lower stopping parts 352 and 362 because the swinging angles are different. That is, in some situations, the leg parts 42 and 43 are contacted with the upper stopping parts 351 and 361 only; and in some other situations, the leg parts 42 and 43 are contacted with the lower stopping parts 352 and 362 only. Optionally, the lower edges of the upper stopping parts 351 and 361 to be contacted with the leg parts 42 and 43 are respectively equipped with chamfering structures 3511 and 3611, and the upper edges of the lower stopping parts 352 and 362 to be contacted with the leg parts 42 and 43 are respectively equipped with chamfering structures 3521 and 3621. Consequently, the abrasions between the upper stopping parts 351, 361 and the leg parts 42, 43 and the abrasions between the lower stopping parts 352, 362 and the leg parts 42, 43 can be alleviated.

Please refer to FIGS. 4B, 5, 6A and 6B again. As mentioned above, the lateral stopping parts 353 and 363 are respectively disposed on the retaining walls 33 and 34 that have elasticity, and the leg parts 42 and 43 are arranged between the lateral stopping parts 353 and 363. The lateral stopping parts 353 and 363 can squeeze or push against the leg parts 42 and 43 from the outside to the inside. Consequently, there is no gap between the lateral stopping part 353 and the leg part 42, and there is no gap between the lateral stopping part 363 and the leg part 43. Since there is no gap between the stabilizer bar 4 and the keycap 3, the stabilizer bar 4 and the keycap 3 do not collide with each other while the keycap 3 is pressed down by the user. Consequently, the noise reduction efficacy is enhanced.

Please refer to FIGS. 2, 5 and 7 again. The keycap 3 further comprises a pillar structure 37. The pillar structure 37 is protruded from the bottom surface 32 of the keycap 3 and toward the frame member 2. In addition, the pillar structure 37 is contacted with the underlying elastic element 5. The frame member 2 comprises a sleeve 22. The sleeve 22 has a hollow portion 221. When the keycap 3 is not pressed by the user, the pillar structure 37 is disposed within the hollow portion 221 of the sleeve 22 and contacted with the underlying elastic element 5. Meanwhile, the circuit board 6 under the elastic element 5 is not triggered. While the keycap 3 is pressed down by the user, the pillar structure 37 is moved downwardly to compress the elastic element 5, and the elastic element 5 is subjected to deformation. The deformed elastic element 5 triggers the underlying circuit board 6. Consequently, the circuit board 6 generates a pressing signal.

In an embodiment, the circuit board 6 is disposed on a supporting member 7. The supporting member 7 and the frame member 2 are fixed on each other or assembled with each other. In an embodiment, the supporting member 7 is a part of the key structure 1. Alternatively, in another embodiment, the supporting member 7 is a component outside the key structure 1. For example, in case that the key structure 1 is installed in a keyboard device, the supporting member 7 is a base plate or a bracket of the keyboard device.

In the above embodiment of the key structure 1, the pillar structure 37 is moved downwardly to compress the elastic element 5, and the deformed elastic element 5 triggers the underlying circuit board 6 to generate the pressing signal. It is noted that numerous modifications and alterations may be made while retaining the teachings of the invention. For example, in another embodiment, the key structure is equipped with a switch under the keycap 3. For example, the switch is installed on the frame member 2. Since the switch itself comprises a resettable pillar, an elastic element (e.g., a spring) and pins, the keycap 3 can directly trigger the switch to generate a pressing signal.

Figure 9:
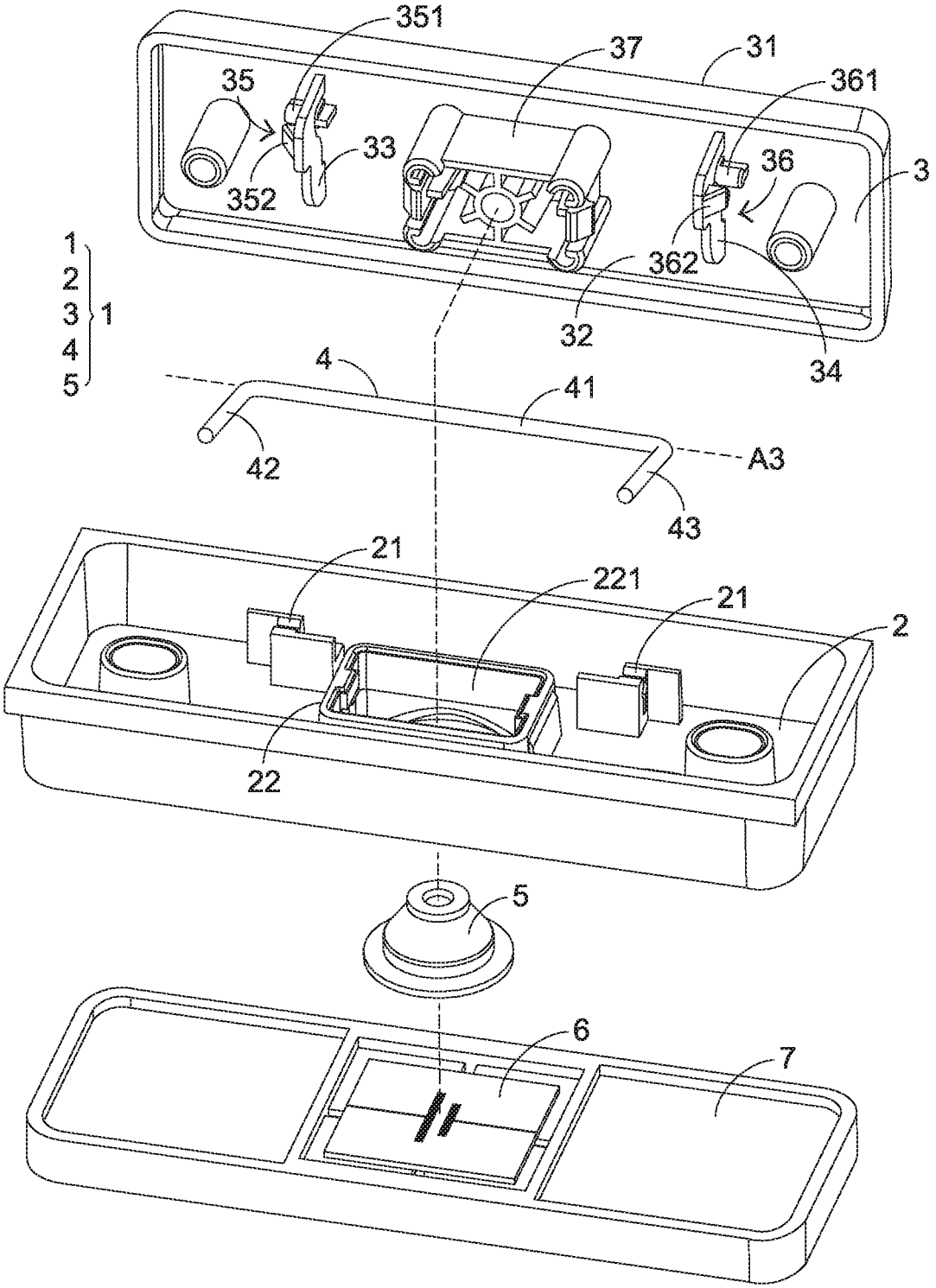
FIG. 9 is a schematic exploded view illustrating a key structure according to another embodiment of the present invention.

Please refer to FIGS. 2, 5, 7 and 8 again. In the above embodiment, the leg parts 42 and 43 of the stabilizer bar 4 are arranged between the lateral stopping parts 353 and 363 of the keycap 3. The lateral stopping parts 353 and 363 can squeeze or push against the leg parts 42 and 43 from the outside to the inside. Consequently, there is no gap between the lateral stopping part 353 and the leg part 42, and there is no gap between the lateral stopping part 363 and the leg part 43. It is noted that numerous modifications and alterations may be made while retaining the teachings of the invention. FIG. 9 is a schematic exploded view illustrating a key structure according to another embodiment of the present invention. In this embodiment, the lateral stopping parts 353 and 363 of the keycap 3 are arranged between the leg parts 42 and 43 of the stabilizer bar 4. Under this circumstance, the lateral stopping parts 353 and 363 can squeeze or push against the leg parts 42 and 43 from the inside to the outside. Consequently, there is no gap between the lateral stopping part 353 and the leg part 42, and there is no gap between the lateral stopping part 363 and the leg part 43.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a frame member comprising at least one hook;

a keycap comprising a bottom surface, a first clamping member and a second clamping member, wherein the bottom surface faces the frame member, the first clamping member comprises a first upper stopping part, a first lower stopping part and a first lateral stopping part, and the second clamping member comprises a second upper stopping part, a second lower stopping part and a second lateral stopping part; and a stabilizer bar arranged between the keycap and the frame member, and comprising a shaft part, a first leg part and a second leg part, wherein the first leg part and the second leg part are formed by bending two ends of the shaft part, respectively, wherein the shaft part is received within the at least one hook, the first leg part is received within the first clamping member, and the second leg part is received within the second clamping member, wherein the first lateral stopping part is pushed against the first leg part along a first direction, and the second lateral stopping part is pushed against the second leg part along a second direction, wherein the first direction and the second direction are opposed to each other.

2. The key structure according to claim 1, wherein the keycap further comprises a first retaining wall, and the first retaining wall is protruded from the bottom surface of the keycap and toward the frame member.

3. The key structure according to claim 2, wherein the first lower stopping part and the first lateral stopping part are disposed on the first retaining wall.

4. The key structure according to claim 2, wherein the first retaining wall has a first opening.

5. The key structure according to claim 4, wherein the first upper stopping part is protruded from the bottom surface of the keycap and toward the frame member, and the first upper stopping part is inserted into the first opening.

6. The key structure according to claim 4, wherein the first opening is a closed-type opening or an open-type opening.

7. The key structure according to claim 1, wherein the keycap further comprises a first pillar structure, and the first pillar structure is protruded from the bottom surface of the keycap and toward the frame member, wherein the frame member further comprises a first sleeve, and the first sleeve has a first hollow portion.

8. The key structure according to claim 7, wherein the key structure further comprises an elastic element and a circuit board, and the first pillar structure is inserted into the first hollow portion and contacted with the elastic element, wherein when the elastic element is subjected to deformation, the circuit board is triggered by the elastic element.

9. The key structure according to claim 1, wherein the first leg part and the second leg part are arranged between the first lateral stopping part and the second lateral stopping part.

10. The key structure according to claim 1, wherein the first lateral stopping part and the second lateral stopping part are arranged between the first leg part and the second leg part.

11. A key structure, comprising:

a frame member comprising at least one hook;

a keycap comprising a bottom surface, a first retaining wall and a second retaining wall, wherein the bottom surface faces the frame member, the first retaining wall and the second retaining wall are protruded from the bottom surface of the keycap and toward the frame member, and the first retaining wall has a first opening; and a stabilizer bar arranged between the keycap and the frame member, and comprising a shaft part, a first leg part and a second leg part, wherein the first leg part and the second leg part are formed by bending two ends of the shaft part, respectively, wherein the shaft part is received within the at least one hook, and the shaft part is only permitted to be rotated along an axial direction through the at least one hook, wherein the first retaining wall is pushed against the first leg part along a first direction, and the second retaining wall is pushed against the second leg part along a second direction, wherein the first direction and the second direction are opposed to each other, and the first retaining wall and the second retaining wall stop the shaft part from being arbitrarily moved along the axial direction.

12. The key structure according to claim 11, wherein the keycap further comprises a first upper stopping part, a first lower stopping part and a first lateral stopping part, wherein the first leg part is received within a region between the first upper stopping part, the first lower stopping part and the first lateral stopping part, and the first lateral stopping part is pushed against the first leg part along the first direction.

13. The key structure according to claim 12, wherein the first upper stopping part is protruded from the bottom surface of the keycap and toward the frame member, and the first upper stopping part is inserted into the first opening, wherein the first lower stopping part and the first lateral stopping part are disposed on the first retaining wall.

14. The key structure according to claim 11, wherein the first opening is a closed-type opening or an open-type opening.

15. The key structure according to claim 11, wherein the keycap further comprises a first pillar structure, and the first pillar structure is protruded from the bottom surface of the keycap and toward the frame member, wherein the frame member further comprises a first sleeve, and the first sleeve has a first hollow portion.

16. The key structure according to claim 15, wherein the key structure further comprises an elastic element and a circuit board, wherein the first pillar structure is inserted into the first hollow portion and contacted with the elastic element, wherein when the elastic element is subjected to deformation, the circuit board is triggered by the elastic element.

17. The key structure according to claim 11, wherein the first leg part and the second leg part are arranged between the first retaining wall and the second retaining wall.

18. The key structure according to claim 11, wherein the first retaining wall and the second retaining wall are arranged between the first leg part and the second leg part.

* * * * *